United States Patent [19]

Hashimoto et al.

[11] 4,407,580

[45] Oct. 4, 1983

[54] TRANSFER DEVICE

[75] Inventors: Shinichi Hashimoto, Fujisawa; Toshimasa Takano, Sagamihara; Hideo Mukai, Yokohama, all of Japan

[73] Assignee: Tokyo Shibaura Denki Kabushiki Kaisha, Kawasaki, Japan

[21] Appl. No.: 257,613

[22] Filed: Apr. 27, 1981

[30] Foreign Application Priority Data

Apr. 30, 1980 [JP] Japan ..... 55-57540
Apr. 30, 1980 [JP] Japan ..... 55-57541
Apr. 30, 1980 [JP] Japan ..... 55-57542

[51] Int. Cl.[3] ..... G03G 15/14; G03G 15/16

[52] U.S. Cl. ..... 355/3 TR; 355/3 BE; 355/3 CH; 355/14 TR

[58] Field of Search ..... 355/3 R, 3 TR, 3 CH, 355/3 BE, 14 TR, 14 CH

[56] References Cited

U.S. PATENT DOCUMENTS 3,832,053 8/1974 Goel et al. ..... 355/3 R
3,879,121 4/1975 Simpson ..... 355/3 R
3,900,591 8/1975 Kline ..... 355/3 TR X
3,966,199 6/1976 Silverberg ..... 355/3 TR X
3,981,498 9/1976 Fletcher ..... 355/3 R X
4,060,320 11/1977 Doi et al. ..... 355/3 R
4,114,536 9/1978 Kaneko et al. ..... 355/3 TR X

FOREIGN PATENT DOCUMENTS 49-37535 10/1974 Japan .

*Primary Examiner*—Fred L. Braun
*Attorney, Agent, or Firm*—Cushman, Darby & Cushman

[57] ABSTRACT

A transfer device with a transfer belt, a plurality of rollers rotatably mounted and supporting the transfer belt and a charger. The transfer belt includes an insulating layer formed on the side facing a photosensitive drum and an electroconductive layer formed on the side opposite to that on which the photosensitive drum is provided. The charger is provided in contact with the surface of the insulating layer to form a surface potential on the surface of the insulating layer. At least one of the rollers is made of an electroconductive material contacts the surface of the electroconductive layer and is grounded.

17 Claims, 22 Drawing Figures

TRANSFER DEVICE

BACKGROUND OF THE INVENTION

This invention relates to a transfer device for transferring a toner image formed on an image forming body to a copying medium and in particular to a transfer device for use in an electrostatic copying apparatus.

In almost all electrostatic copying apparatuses currently available, direct transferring by the corona charger is used to form a non-contacting type device. A conventional method is known in which as shown in FIG. 1 a corona charger 12 is disposed opposite to the surface of an endless belt 10 to permit the insulating belt 10 to be charged by the corona charger 12. The charged belt 10 is pressed by a compression roller 14 against the surface of a photosensitive drum 16. In this state, a copying paper is sandwiched between the photosensitive drum 16 and the insulating belt 10 to cause a toner image on the surface of the photosensitive drum 16 to be transferred to the copying paper.

Use may also be made of a transfer device as shown in FIG. 2 in which a corona charger 12 is disposed opposite to the rear surface of the insulating belt 10.

In either transfer device, a high voltage is required for the corona charging of the corona charges, involving a lot of risk. During the corona charging, ozone is generated, causing a possible air contamination as well as a possible contamination of the inner mechanism of the electrostatic copying apparatus. Further, the corona charge 12 is expensive and provides a bar to the cost reduction of the electrostatic copying apparatus.

In the above-mentioned transfer operation, on the other hand, the insulating belt 10 is electrically charged. Such amount of charge is cumulated for each copying operation, resulting in a change in amount of charge per each copying operation. This necessitates providing a discharger for discharging the charged insulating belt for each copying operation.

SUMMARY OF THE INVENTION

It is accordingly the object of this invention to provide a transfer device capable of effecting transfer without using a corona charger and capable of preventing a possible air contamination and possible contamination of associated parts by ozone.

According to an aspect of the present invention there is provided a transfer device for an electrostatic copying apparatus comprising an image forming body on which a toner image made of a toner charged with a predetermined polarity is formed, in which a transfer device including a transfer belt adapted to be run in a manner to face the image forming body and holding a copying medium relative to the image forming body, a plurality of rollers rotatably mounted and supporting the transfer belt such that the belt can be run, and a charger for causing that surface of the transfer belt which is located on the image forming body side to be charged with a polarity opposite to said predetermined polarity, wherein said transfer belt includes a first layer formed on the side at which it faces said image forming body and a second layer formed on the side opposite to that on which said image forming body is provided, said first layer being formed of a material having a resistivity of above $10^{10}$ Ωcm and said second layer being formed of a material having a resistivity lower than said resistivity of said first layer, said charger is provided in contact with the surface of said first layer to form a surface potential on the surface of said first layer, and at least one of said rollers is made of an electroconductive material, which contacts the surface of said second layer and is grounded.

According to this invention a transfer belt is comprised of an outer electrically insulating layer and inner electroconductive layer and a contacting charger is provided to electrically charge the insulating layer with a polarity opposite to that of toner particles for forming a toner image. This invention has, therefore, the following advantages:

(a) Since the inner electroconductive layer of the transfer belt acts as an electrode, the charging position relative to the insulating layer, as well as the position where an image is transferred from the photosensitive body, can be freely set, and the position of a roller for running the transfer belt is not restricted.

(b) The width of a nip between the photosensitive body and a transfer belt in contact with the photosensitive body can be made greater and thus an impressed voltage can be made lower.

(c) If the voltage is continuously impressed to the transfer belt, a surface potential is not superposed onto the impressed voltage such that it is increased. Thus, it is possible to always obtain a predetermined surface potential corresponding to the impressed voltage.

(d) A contacting pressure of a copying paper relative to the photosensitive body is made uniform. The copying paper is conveyed while electrostatically attracted by electric charges on the transfer belt and, since an attractive force by the electric charges on the transfer belt is greater than an attractive force by electric charges on the surface of the drum, the copying paper is not wrapped around the surface of the drum. Therefore, no extra stripping member such as a tape or a belt is necessary. As a result, a transfer image can be transferred over the whole area without leaving what we call a stripping allowance.

DETAILED DESCRIPTION OF THE PREFERRED EMBODIMENTS

Figure 1:
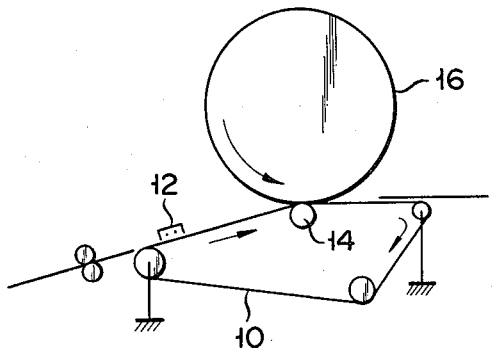
FIG. 1 PRIOR ART
FIGS. 1 and 2 are diagrammatic views each showing a conventional belt type transfer device.
Figure 2:
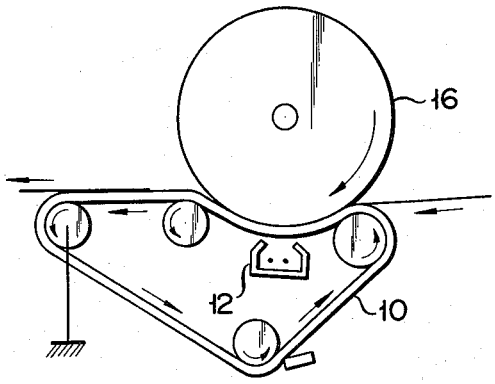
FIG. 2 PRIOR ART
Figure 3:
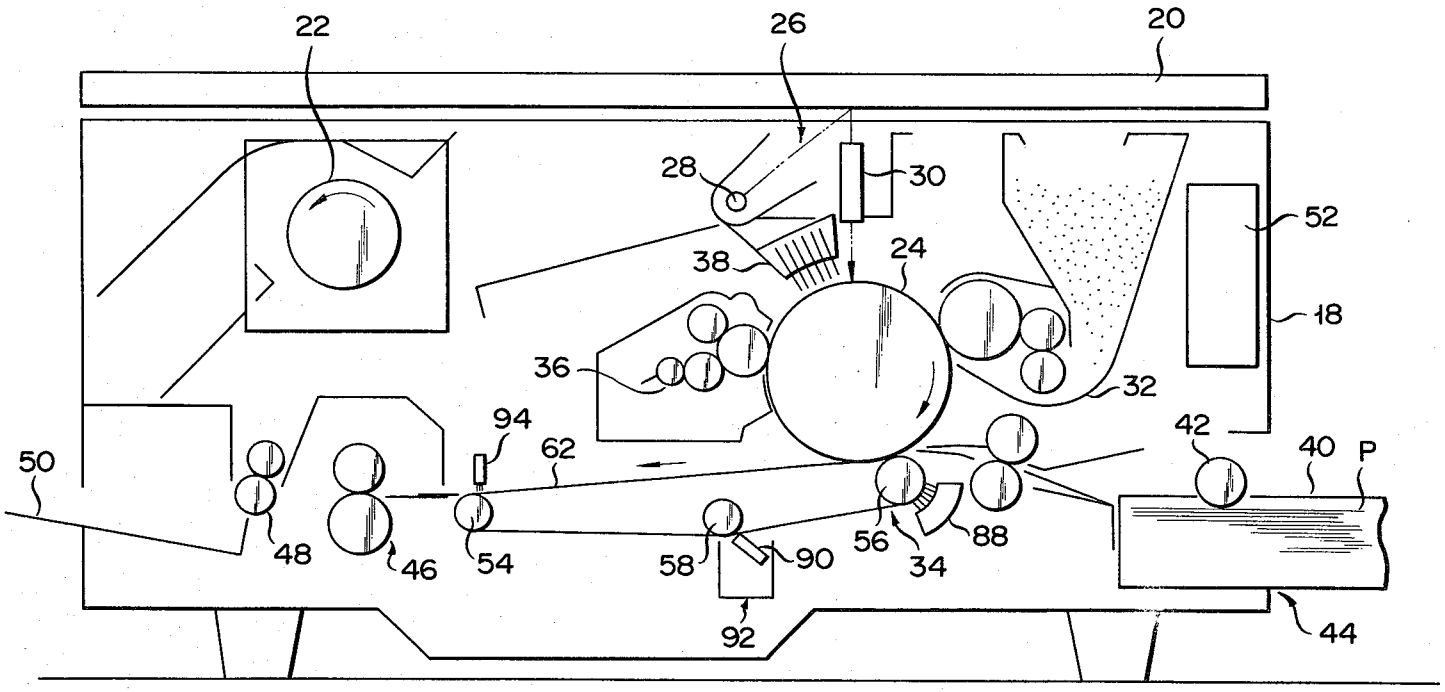
FIG. 3 is a diagrammatic view showing an electrostatic copying apparatus equipped with a transfer device according to a first embodiment of this invention.
Figure 4:
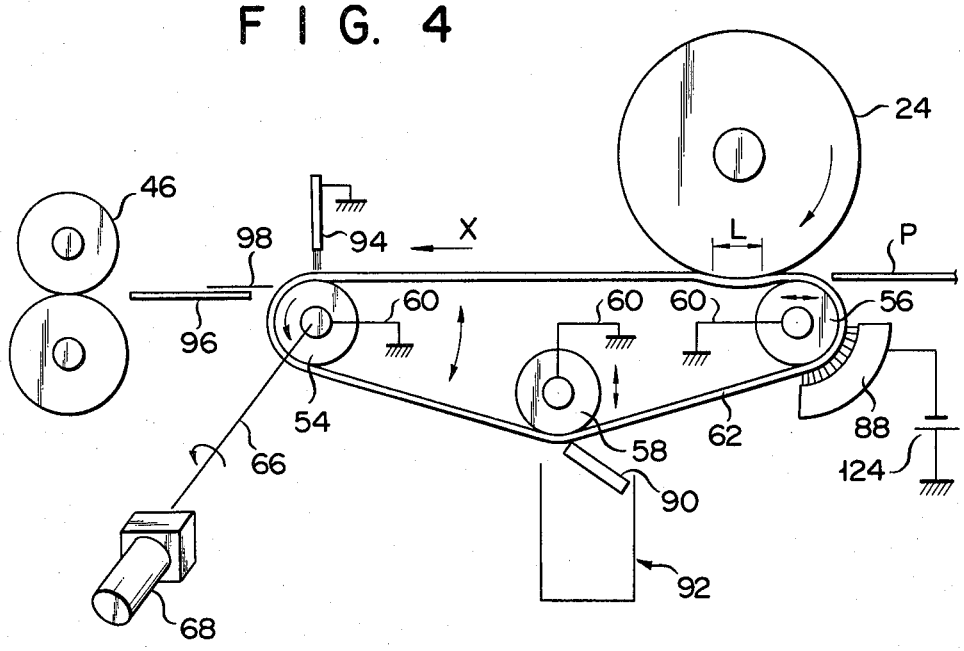
FIG. 4 is a front view diagrammatically showing the transfer device as shown in FIG. 3.
Figure 5:
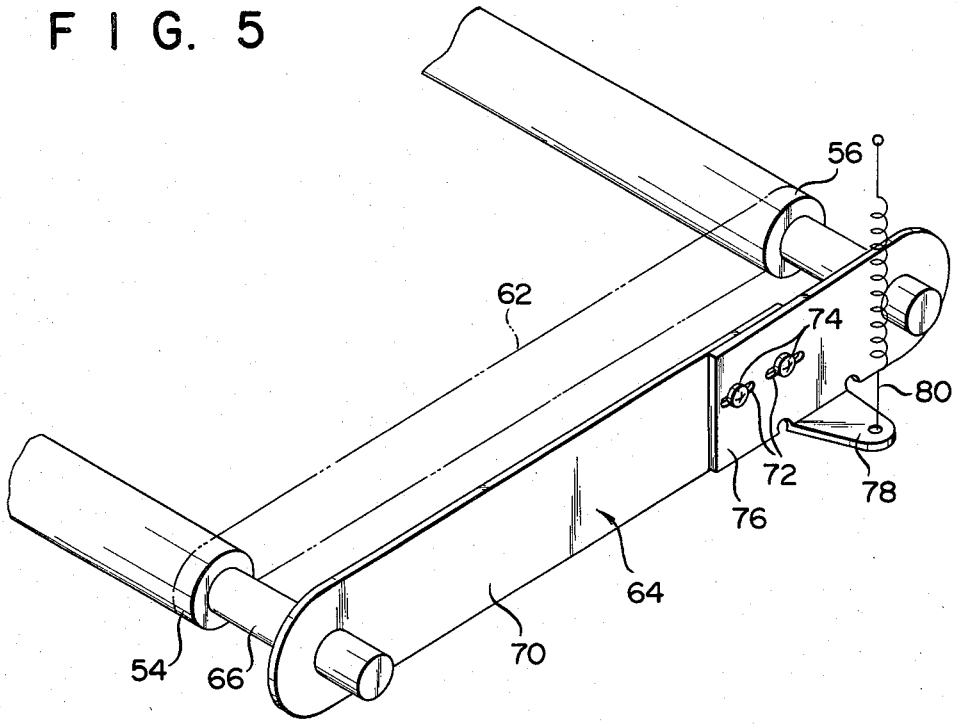
FIG. 5 is a perspective view showing a bracket as used in the transfer device.
Figure 6:
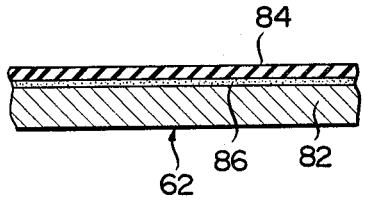
FIG. 6 is a cross-sectional view showing a transfer belt as used in the transfer device.

A first embodiment of a transfer device according to this invention will be explained in more detail below by referring to FIGS. 3 to 9 of the enclosed drawings.

In the drawings, reference numeral 18 shows a body of an electrostatic copying apparatus. An original rest 20 is disposed on the upper surface of the body 18 such that it can be reciprocably moved. The original rest 20 is driven by a drive motor 20 which is mounted within the body 18. A photosensitive drum 24 as an image forming body is rotatably supported at substantially the center of the body 18. The photosensitive drum 24 comprises a cylindrical body and a photosensitive layer made of a photoelectroconductive material and formed on the outer peripheral surface of the cylindrical body. In this embodiment, zinc oxide diffused with resin is used as photoelectroconductive material. The photosensitive drum 24 is driven by the drive motor 22 such that it is rotated in a direction indicated by an arrow in FIG. 3 i.e. in a clockwise direction. The movement of the original rest 20 is synchronized with the rotation of the photosensitive drum 24.

An image exposure mechanism 26 is disposed within the body 18 such that it is located between the photosensitive drum 24 and the original rest 20. The image exposure mechanism 26 includes a lamp for illuminating the original on the rest 20 and a focusing light transmitter 30 for causing a reflective light from the original to be conducted to the surface of the photosensitive drum 28 i.e. the photosensitive layer. The image exposure mechanism 26 illuminates the original on the rest 20 and causes a reflective light from the original to be conducted onto the photosensitive drum 24 where an original image is focused. Around the photosensitive drum 24 are disposed a developing device 32, transfer device 34 to be later described, cleaning device 36 and charging device 38 in that order along the rotation direction of the photosensitive drum 24 starting with the focusing position. The developing device 32 causes an electrostatic latent original image on the surface of the photosensitive drum 24 to be translated by a toner into a visual image.

On one end portion of the bottom section of the body 18 is mounted a paper supply device 44 including a detachable cassette 40 for receiving a stack of copying papers P to be copied and a paper feed roller 42 for feeding the copying paper one by one toward a nip between the photosensitive drum 24 and the transfer device 34. Near to the transfer device 34 are disposed a fixing device 46 for fixing the toner image on the copying paper P to which an image has been transferred and a delivery roller 48. The delivery roller 48 causes the copying paper so fixed by the fixing device 46 to be delivered toward a tray 50. Reference numeral 52 shows a control device for controlling the above-mentioned copying operation.

The transfer device 34 will be explained in more detail below.

Reference numeral 54 shows a driver roller and reference numerals 56 and 58 driven rollers. The rollers 54, 56 and 58 are made of an electroconductive material and connected to a ground terminal 60 respectively. A transfer belt 62 is stretched over on the rollers 54, 56 and 58. A part of the transfer belt 62 is contacted with the outer periphery of the photosensitive drum 24. The drive roller 54 and driven roller 56 are supported at one end by one and the other end of one of a pair of brackets 64, 64 and at the other end by one and the other end of the other bracket. The driver roller 58 is rotatably journaled on a frame (not shown) which is movable up and down. One end of the drive roller 54 is connected to a drive motor 68 through a drive shaft 66. That is, the bracket 64 is rotatably supported with the drive shaft 66 as a fulcrum. The free end of the bracket 64 i.e. the end of the bracket 64 which supports the driven roller 56 can be extended in a longitudinal direction. The bracket 64 comprises a main body 70 which supports the drive roller 54 and a movable section 76 on the side of which the driven roller 56 is supported, the movable section 76 is attached to the main body 70 by means of screws 74 and elongate holes 72 provided in the main body 70 and extending in the longitudinal direction of the main body 70 of the bracket. The distance between the drive roller 54 and the driven roller 56 is adjusted by moving the movable section 76 relative to the main body 70 of the bracket 64. By so doing, the tension of the transfer belt 62 can be adjusted. A tab 78 is projected from the movable section 76 of the bracket 54. A spring 80 is provided between the tab 78 and the frame (not shown) to urge the driven roller 56 into pressure contact with the photosensitive drum 24. Namely the spring 80 is provided in such a direction that an amount of contact (nip width), L, of the transfer belt 23 with the photosensitive drum 24 is increased.

The transfer belt 62 is comprised of an electroconductive layer (or a second layer) 82 with a resistivity of below $10^8$ Ω.cm, an insulating layer (or a first layer) 84 laid on the outer periphery of the electroconductive layer 82 with a resistivity of below $10^{10}$ Ωcm and a bonding layer 86 for bonding the electroconductive layer to the insulating layer 84. According to experiment it has been found that a polyester film of 10 μm to 100 μm in thickness is preferred as the insulating layer 84. It has also been found that, the smaller a variation in the thickness of the insulating layer 84, the smaller a variation in the charge density and thus the smaller charging irregularity. That is, the bonding layer 86, if having an electroconductivity, is preferred, because a variation in the thickness of the insulating layer 84 becomes smaller.

In proximity to the driven roller 56 is provided a contacting type charger 88 for causing the insulating layer 84 of the transfer belt 62 to be charged with a polarity opposite to that of the toner particles on a toner image which is formed on the photosensitive drum 24. Near to the driven roller 58 is provided a cleaning device 92 having a blade 90 for scraping the toner off the outer surface of the transfer belt 62. A non-contacting type discharger 94 is disposed near to the drive roller 54 to discharge the copying paper P which is electrostatically attracted toward the transfer belt 62. The discharger 94 has a carbon fiber currently available under the trade mark of, for example, ZERO-STAT (K.K. NAKATANI), TORAYCA (TORAY K.K.) or a SUS fiber currently available under the trade mark of ACHILLES NONSPARK (KOKOKU KAGAKU KOGYO K.K.). The fiber is upwardly spaced several millimeters off the copying paper P and grounded. By so doing, the fiber can discharge the copying paper P and transfer belt 62 without using any power supply device. A stripping device 98 is provided to a guide member 96 which causes the copying paper P after transfer has been completed to be conducted to the fixing device 46. The stripping device 98 is comprised of, for example, a polyester film of about 50 μm to 200 μm in thickness and adapted to be brought into proximity to, or into contact with, the transfer belt 62, permitting the discharged copying paper P to be positively stripped off the transfer belt 62.

Figure 7:
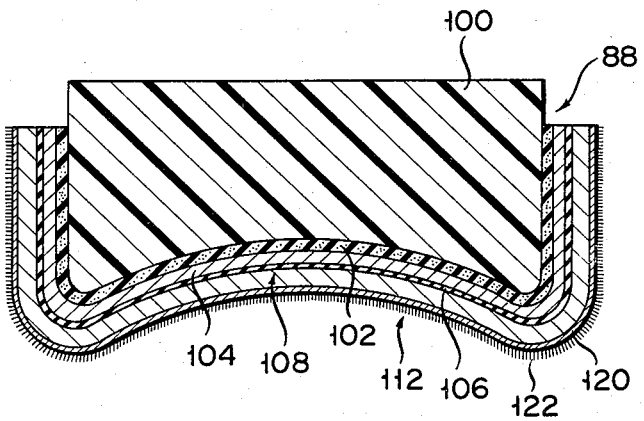
FIG. 7 is a cross-sectional view, as taken in a vertical direction, showing a charger as used in the transfer device.
Figure 8:
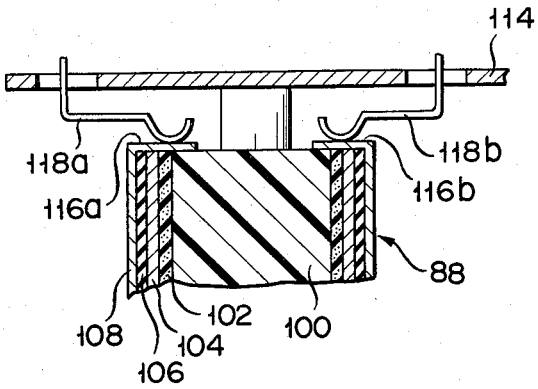
FIG. 8 is a cross-sectional view, as taken in a horizontal direction, showing a charger as shown in FIG. 7.

The contacting type charger 88 will now be explained below by referring to FIGS. 7 and 8. In these Figures, reference numeral 100 shows a charger base made of synthetic resin material such as acrylic or ABS resin. The bottom surface of the charger base 100 is arcuately formed along the curvature of the transfer belt 62. A cushion layer 102, heater layer 104, insulating layer 106, electrode 108 and contact element 112 are superposed in that order in a multi-layer fashion on that bottom surface of the charger base 100 which confronts the outer surface of the transfer belt 62. The respective layers extend from the bottom surface of the charger base 100 toward both the side surfaces of the charger base 100 to cover the bottom of the charger base 100.

The cushion layer 102 is formed of a foamed synthetic resin sheet of about 3 mm in thickness and has, in addition to a damping function, an electrically insulating function. The heater layer 104 is adapted to heat the contact element 112 at all times so that the contact element 112 has its resistance not varied under the damp condition of the element 112. The heater layer 104 is comprised of a low-power heater of several watts. The insulating layer 106 is adapted to insulate the heater layer 104 in cooperation with the cushion layer 102. The insulating layer 106 is comprised of a polyester film (trade name: MYLAR) of about 25 μm in thickness. The electrode 108 is formed of a sheet-like electroconductive rubber of about 50 μm in thickness. The electroconductive rubber is formed by mixing a first solution and second solution in a ratio of 1:1, the first solution being prepared by mixing with 82.5 weight percent of a solvent and 17.5 weight percent of a solids component which is obtained by mixing 30 weight percent of carbon (manufactured by CABOT Co. under the trade mark of VULCAN XC-72), 50 weight percent of SBR (manufactured by ASAHI KASEI KOGYO K.K. under the trade mark of TUFPRENE) and 20 weight percent of Xylene resin (manufactured by MITSUBISHI GAS KAGAKU K.K. under the trade mark of NIKANOL) and the second solution being prepared by mixing 50 weight percent of SBR and 50 weight percent of a solvent such as toluene. The resultant electrode 108 has its resistivity maintained at $10^5$ to $10^7$ Ω.cm.

The ends of the electrode 108 provided on a rear frame 114 side are bent along the rear end surface of the charger base 100. These bent portions constitute contact terminals **116*a* and 116*b*. On the rear frame 114 opposite to the contact terminals 116*a* and 116*b* a pair of power supply blades 118*a*, 118*b* are mounted such that they are contacted with the respective contact terminals 116*a* and 116*b*. In this embodiment, the contact element 112 is comprised of a napped cloth with a resistivity higher than that of the electrode 108. As such cloth use is made of velveteen having a resistivity of $10^8$ Ω.cm. The velveteen comprises a cotton fiber base 120 and furs 122 which are oriented outwardly from the fiber base 120. The fur 122 is made of nylon fibers having an electroconductivity. Each fur 122** is set in a range of 1.5 to 10*d* (denier) in thickness and 0.5 to 3 mm in length and, in this embodiment, is 5*d* in thickness and 2 mm in length. The contact element 112 is bonded by an electroconductive bonding agent to the electrode 108. The electrode 108 is connected to a bias DC power supply source 124 having an output of, for example, −1.8 kV. The charger 88 is disposed in a casing such that the furs 122 are contacted with the outer insulating layer 84 of the transfer belt 62. A surface potential of −1.5 kV is created on the insulating layer 84 by applying DC voltage from the DC power supply.

The operation of the electrostatic copying apparatus so arranged will now be explained below.

When the photosensitive drum 24 starts a rotation, the drive motor 68 of the transfer device 34 starts its rotation and a voltage of 1.8 kV is applied to the transfer belt 62 through the DC power supply source 124. The transfer belt 62 is run, in a direction of an arrow X, in synchronism with the rotation of the photosensitive drum 24. At the same time, the insulating layer 84 of the transfer belt 62 is charged with a polarity (i.e. charged negative) opposite to that of the toner particles on the toner image. When in this state the copying paper P is supplied toward a nip between the photosensitive drum 24 and the transfer belt 62, the copying paper P is dielectrically polarized by the electric charge on the transfer belt 62, attracting a toner image on the photosensitive drum 24 to permit the toner image to be transferred thereto. Since the surface potential on the transfer belt 62 is set higher than the surface potential on the photosensitive drum 24, transfer is effected. For example, the surface potential of the photosensitive drum 24 having a photosensitive layer made of ZnO is set at −450 to −500 V, whereas the surface potential on the transfer belt 62 is set at about −1.5 kV.

The copying paper to which the toner image is transferred is electrostatically attracted to the transfer belt 62 and carried with the running of the transfer belt 62. When the copying paper P reaches a position where it confronts the discharger 94, both the transfer belt 62 and copying paper P are discharged by the discharger. Thereafter, the transfer belt 62 is directed toward the cleaning device 92 and the copying paper P is stripped by the stripping device 98 from the transfer belt 62. After the toner image on the copying paper P is fixed by the fixing device 46, the copying paper P is delivered toward the tray 50. The toner deposited on the transfer belt 62 from which the copying paper P has been stripped is removed by the blade 90 of the cleaning device 92, and the transfer belt 62 thus cleaned is directed toward the charger 88.

Even if in this case, the toner for forming the toner image on the photosensitive drum 24 is a magnetic one, the toner image can be transferred to a plain paper. The transfer belt 62 may be linearly contacted with the photosensitive drum, but if a proper nip width L is provided a better transfer efficiency is obtained. By adjusting the tension of the spring 80 the driven roller 56 can be urged toward the photosensitive drum 24. By so doing, the nip width L can be properly set. A distance between the drive roller 54 and the driven roller 56 can be controlled for the tension adjustment of the transfer belt 62, by loosening the screw 74 relative to the movable section 76 of the bracket 64 and slidably and axially moving the movable section 76 relative to the main body 72 of the bracket 64. This arrangement provides a countermeasure against the elongation of the transfer belt 62.

Since the drive roller 54 for running the transfer belt 62 is provided on that side where the copying paper P is delivered, tension is imparted to that side of the copying paper P where the conveying section of the transfer belt is located. This arrangement prevents the undulation of the copying paper P and provides a uniform pressure of contact of the copying paper with the photosensitive drum 24. It is therefore possible to prevent unauthorized displacement of the transferred image.

As many apparently widely different embodiments of this invention may be made without departing from the spirit and scope thereof, it is to be understood that the invention is not limited to the specific embodiments thereof except as defined in the appended claims. In the following explanation, identical numerals are employed throughout the Figures to denote identical parts or elements and further explanation thereof is therefore omitted.

Figure 9:
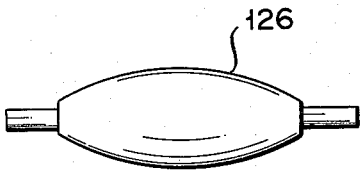
FIG. 9 is a front view showing a first modification of the first embodiment of the transfer device according to this invention.

FIG. 9 shows a first modification of the first embodiment of transfer device according to this invention. In FIG. 9 a drive roller 50 is equipped with a crown section. This arrangement prevents the unauthorized displacement of the transfer belt 62 during running.

Figure 10:
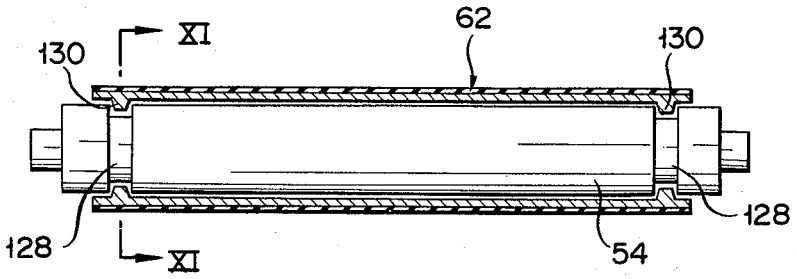
FIG. 10 is a cross-sectional view showing a second modification of the transfer device according to this invention.
Figure 11:
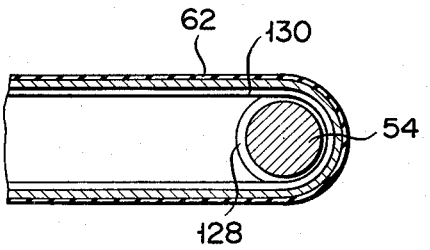
FIG. 11 is a cross-sectional view as taken along line XI—XI of FIG. 10.

FIGS. 10 and 11 show a second modification of the first embodiment of transfer device according to this invention. In this transfer device, the running of the transfer device is stabilized. That is, a pair of annular grooves 128 are provided one at each end portion of the drive roller 54. An annular projection 130 is provided at one longitudinal side edge, or one at each longitudinal side edge, of the rear side of the transfer belt to engage with the annular groove 128. This arrangement prevents unauthorized displacement of the transfer belt during the run of the transfer belt, assuring a stabilized run of the transfer belt.

Figure 12:
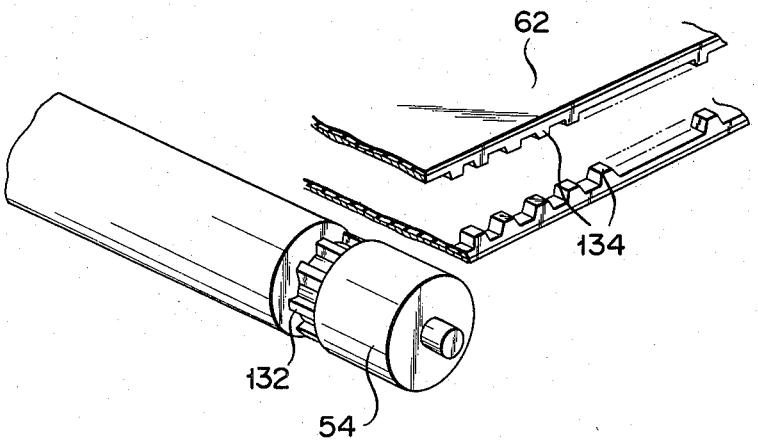
FIGS. 12 and 13 are perspective and cross-sectional views, respectively, showing a third modification of the transfer device according to this invention.
Figure 13:
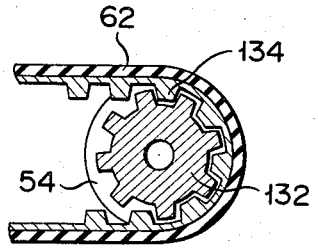

FIGS. 12 and 13 show a third modification of the first embodiment of transfer device according to this invention. This arrangement prevents unauthorized displacement of the transfer belt 62 and assures a constant peripheral speed. A pair of gears 132 are disposed one at each end portion of the drive roller 54. A continuous serrated section 134 is provided at one longitudinal side edge, or one at each longitudinal side edge, of the rear side of the transfer belt 62 to engage with the gear 132. This arrangement prevents slippage of the transfer belt 62 as well as unauthorized displacement of the transfer belt. Moreover, the transfer belt can be synchronized with the photosensitive drum 24.

Although the drive roller 54 has been explained in connection with the modifications of transfer device, the driven rollers 56 and 58 can take the same configuration.

Figure 14:
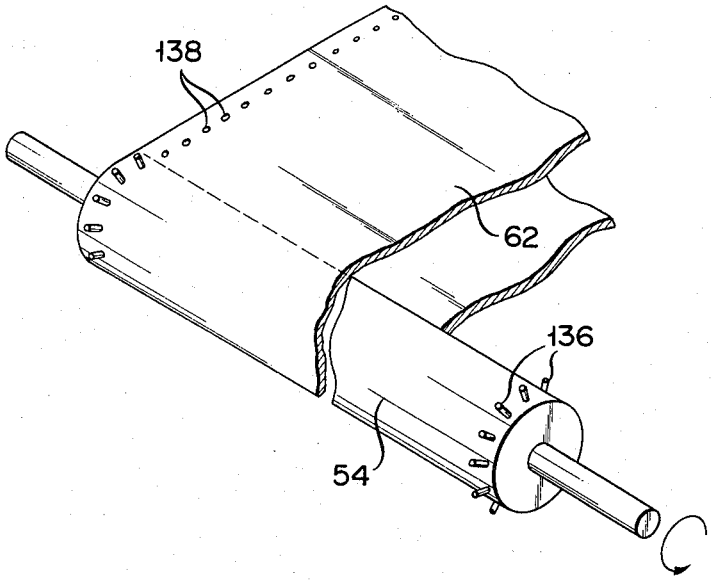
FIG. 14 is a perspective view showing a fourth modification of the transfer device according to this invention.

FIG. 14 shows a fourth modification of the first embodiment of transfer device according to this invention. This arrangement prevents unauthorized displacement of the transfer belt 62 and provides a constant peripheral speed. That is, pins 136 are projected at an equal pitch in a sprocket fashion at one end portion, or one at each end portion, of the drive roller 54. Feed holes 138 are provided in one longitudinal side edge, or one at each longitudinal side edge, of the transfer belt 62.

Figure 15:
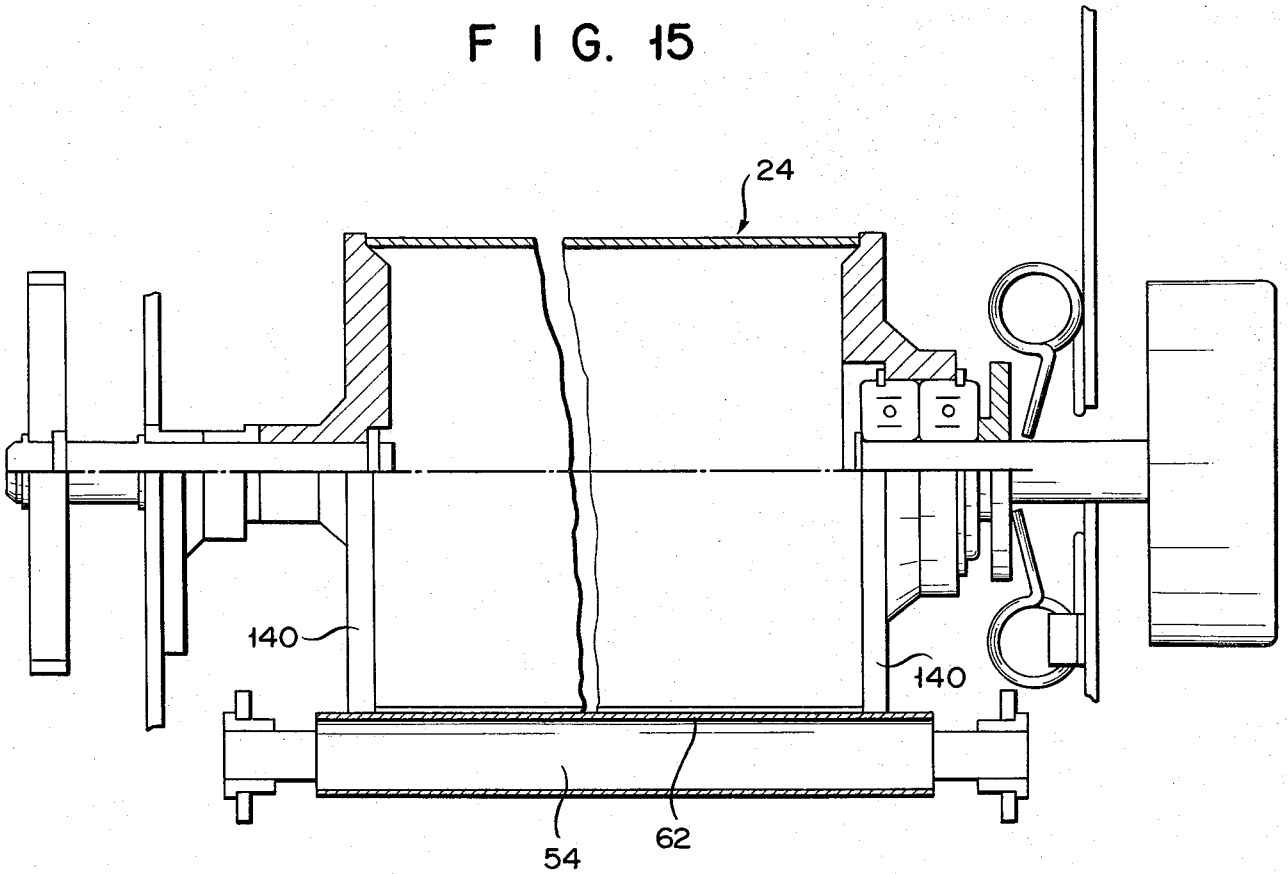
FIG. 15 is a view, partly in cross-section, showing a fifth modification of the transfer device according to this invention.

FIG. 15 shows a fifth modification of the first embodiment of transfer device according to this invention. In this arrangement, the photosensitive drum 24 is in interlock with the transfer belt 62 so as to provide synchronization. That is, a pair of flanges 140 are provided on the ends of the photosensitive drum 24, causing the outer peripheral surfaces of the flanges to be roll-contacted with the outer longitudinal edges of the transfer belt 62 to permit the rotation force of the photosensitive drum 24 to be transferred directly to the transfer belt 62. This arrangement permits the speed of the photosensitive drum 24 to be synchronized with the speed of the transfer belt 62, and obviates the necessity of providing a drive source for running the transfer belt 62. If a sprocket is provided on the flange 140 and holes are provided on the transfer belt 62 to engage with the projections of the sprocket, a more positive power transmission can be assured.

Figure 16:
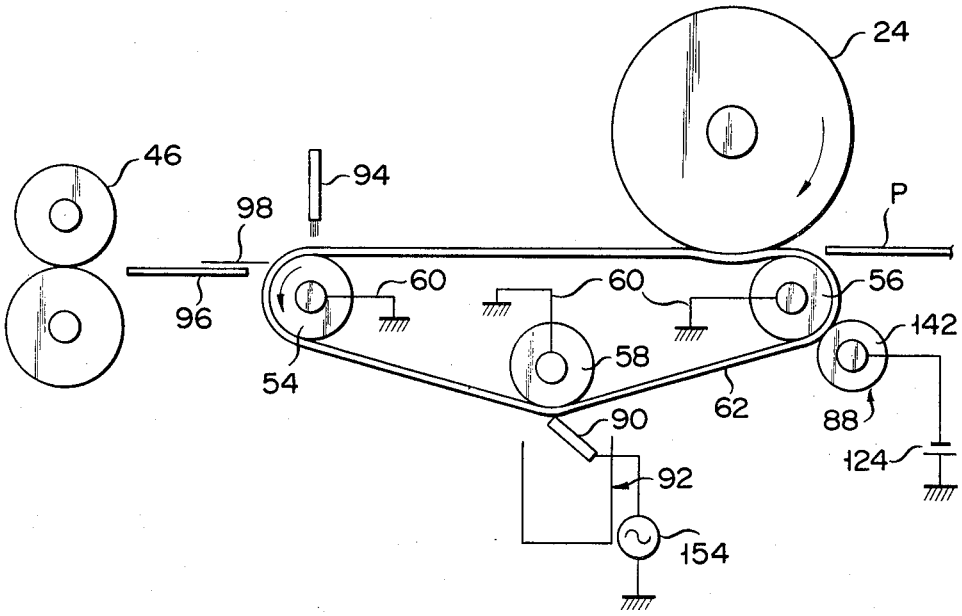
FIG. 16 is a front view diagrammatically showing a transfer device according to a second embodiment of this invention.

FIG. 16 shows a transfer device according to second embodiment of this invention. In this embodiment, an electroconductive roller 142 is used as a contacting type charger for electrically charging a transfer belt 62. The electroconductive roller 142 contacts that portion of electroinsulating layer 84 of the transfer belt 62 which is opposite to a portion of the electroconductive layer 82 of the transfer belt 62 contacting with the driven roller 56 and supplied with a negative voltage of a DC power supply 124 whose positive terminal is connected to a ground terminal. If in this case the resistivity of the electroconductive roller 142 is below $10^3$ Ωcm and −3 kV is applied by the DC power supply 124 to the electroconductive roller 142, a surface potential of −1.5 kV to −1 kV is obtained on the transfer belt 62.

Figure 17:
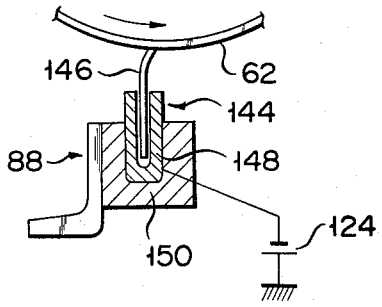
FIG. 17 is a cross-sectional view showing a charger as used in a transfer device according to a third embodiment of this invention.

FIG. 17 shows a transfer device according to a third embodiment of this invention. In this embodiment, a carbon brush 144 is used as a contacting type charger for electrically charging the transfer belt 62. The carbon brush 144 comprises a carbon fiber 146 currently available under the trade mark of Torayca and an electrode 148 sandwiching the base portion of the carbon fiber 146 and connected to the DC power supply 124. The electrode 148 is fitted in an insulating holder 150. The tip of the carbon fiber 146 is lightly contacted with an insulating layer 84 of the transfer belt 62.

Figure 18:
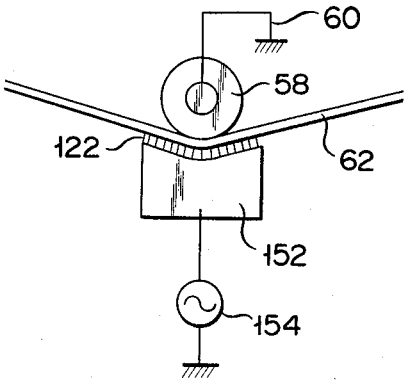
FIG. 18 is a front view diagrammatically showing a cleaning device as used in a transfer device according to a fourth embodiment of this invention.

FIG. 18 shows a transfer device according to a fourth embodiment of this invention. In this embodiment, as a cleaning device 152 use is made of one basically the same as the contacting type charger 88. The cleaning device 152 is connected to an AC power supply 154. By applying an AC electric field to the cleaning device 152 the charges on the transfer belt 62 and toner charges are neutralized and the toner deposited on the transfer belt 62 can be scraped by furs 122 off the transfer belt 62. As in the fourth embodiment, the blade 90 as shown in FIG. 16 may be connected to an AC power supply 154 and an AC electric field be applied to the blade 90.

As a modification of fourth embodiment, the toner may be attracted toward the furs 122 of the cleaning device 152 by applying a DC electric field of a polarity opposite to that of the toner. The cleaning device 152 may be connected to a ground terminal so as to serve not only as a discharger unit, but also a cleaning unit. In this case, no electric field is applied. When, on the other hand, an AC electric field is applied to the cleaning device, the cleaning device can discharge the toner and at the same time refresh the soiled surface of the transfer belt 62. If an AC electric field and a DC electric field of a polarity opposite to that of the toner are applied to the cleaning device 152 in a superposed fashion, the cleaning effect is more improved.

Where a magnetic toner is used, the problem with PPC (plain paper copy) resulting from the magnetic field is the blurring of an image due to the toner being transferred, during the transfer time, back to the photosensitive drum side. Such a phenomenon is prominently observed when a magnetic toner of a lower resistance is used or a high humidity is involved. A countermeasure against this phenomenon is to use a magnetic toner of a higher resistance and a special treated paper. However, the complexity of a developing mechanism necessary to avoid high resistance toner phenomenon, as well as the restriction of paper used (i.e. no plain paper copy can be used), poses another problem. Since in the transfer device of this invention the polarized surface charges of the transfer belt equipped with the insulating layer are used as a surface potential necessary for transfer, an adequate transfer efficiency can be obtained without relying upon the quality of the copying paper and the resistive value of the toner. This permits the ready transfer of the magnetic toner of a lower resistance which has been difficult in the conventional transfer device.

A development and transfer were effected under a humidity of 80% by using a magnetic toner of $10^8$ Ωcm and a better result was able to be obtained with a better transfer efficiency and without the blurring of an image.

Methods for the manufacture of the transfer belt 62 of the transfer device 34 will be explained below by referring to FIGS. 19 to 22.

Figure 19:
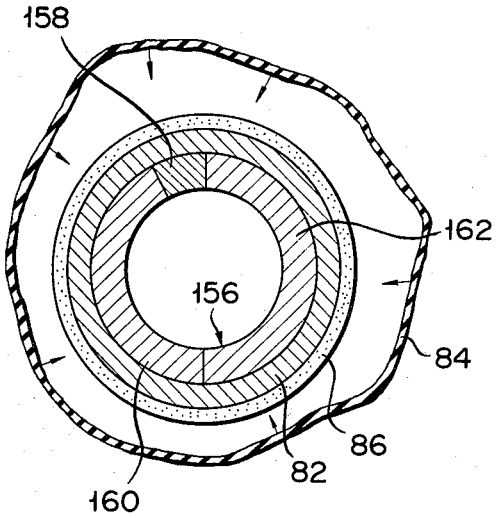
FIGS. 19 and 20 are cross-sectional views showing a first method of manufacturing a transfer belt according to this invention.
Figure 20:
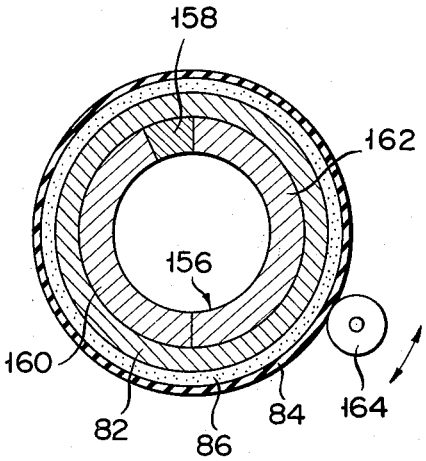

FIGS. 19 and 20 show a first method for the manufacture of the transfer belt 62. As shown in FIG. 19 an electroconductive layer 82 made of an electroconductive rubber or an electroconductive cloth-embedded rubber belt is wrapped around the outer peripheral surface of an annular core metal 156. The core metal 156 comprises a small division piece 158 and two large division pieces 160, 162. An electroconductive bonding agent 86 is coated on the outer surface of the electroconductive layer 82 and then an insulating layer 84 formed of a cylindrical polyester film is loosely covered on the outer peripheral surface of the electroconductive layer 82. Then, the insulating layer 84 is, while being heated by a heating roller 164, pressed against the electroconductive bonding agent 86, causing the layer 82 to be heat-shrunk to permit the layer 82 to be intimately contacted with the outer peripheral surface of the electroconductive bonding agent 86. By so doing, the electroconductive layer 82 is bonded by the electroconductive bonding agent 86 to the insulating layer 84. After such bond is effected, the core metal can be readily taken out by withdrawing the division pieces of the core metal. As a result, an endless transfer belt 62 is formed.

Although in any of the above-mentioned embodiments a polyester film is used for the insulating layer 84, use can also been made of a synthetic resin film such as polyethylene, Teflon, vinyl chloride and nylon. The insulating layer 84 may be thermally fused directly to the electroconductive layer 82 without placing the bonding agent 86 therebetween. As the electroconductive layer 82 use may be made of an electroconductive rubber formed by impregnating carbon in NBR (nitrile-butadiene rubber), SBR (styrene-butadiene rubber) etc., a belt embedded with an electroconductive cloth, an electroconductive rubber embedded with carbon fibers etc.

Figure 21:
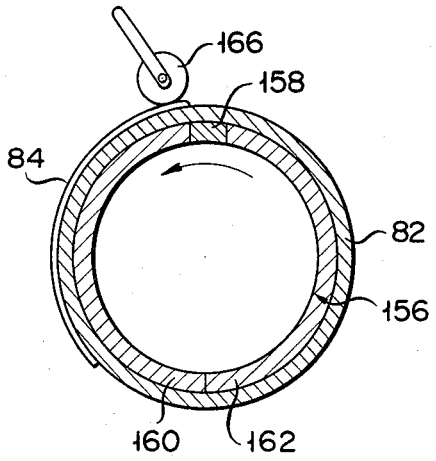
FIG. 21 is a cross-sectional view showing a second method of manufacturing a transfer belt according to this invention.

FIG. 21 shows a second method for the manufacture of the transfer belt 62. In this method, an insulating layer 84 on the outer peripheral surface of a core metal 156 is coated by a coating roller 166.

Figure 22:
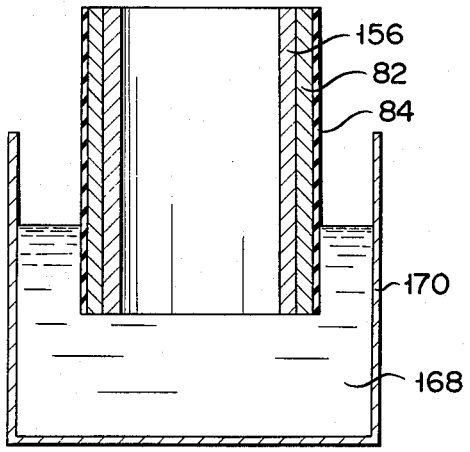
FIG. 22 is a cross-sectional view showing a third method of manufacturing a transfer belt according to this invention.

FIG. 22 shows a third method for the manufacture of the transfer belt 62. In this method, an insulating material 168 by which the insulating layer 84 is formed is dissolved by a solvent and held in a bath 170. The electroconductive layer 82 supported on the core metal 156 is dipped into the dissolved insulating material to form the insulating layer 84 on the outer peripheral surface of the electroconductive layer 82. As a means for fitting the electroconductive layer 82 and insulating layer 84 together, the sputtering of metal such as an aluminium evaporation may be used, whereby an electroconductive layer 82 is formed.

According to the second and third methods for the manufacture of the transfer belt 62 an insulating layer 84 has the following components:

| | |
|---|---|
| A solution | a water-soluble polyester resin<br>. . . 45 weight percent<br>(available under the trade name of<br>VYLON-300: TOYOBOUSEKI K.K.)<br>a polyvinyl chloride-acetate copolymer<br>(molecular weight 2100) . . . 45 weight percent<br>(available under the trade name of VMCM:<br>Union Carbide Co.)<br>a cross-linking agent . . . 10 weight percent<br>(available under the trade name of<br>CORONATE:<br>NIPPON POLYURETHAN KOGYO K.K.) |
| B solution | MEK (methyl ethyl ketone)<br>. . . 50 weight percent<br>toluene . . . 50 weight percent |

The A and B solutions are mixed together in a ratio of 1:4. Therefore, the resultant insulating layer 84 has a flexibility and an excellent wear-resistance and voltage withstanding property.

What we claim is:

1. In a transfer device for an electrostatic copying apparatus including an image forming body on which a toner image made of a toner charged with a predetermined polarity is formed, comprising:

a transfer belt adapted to be run in a manner to face the image forming body and holding a copying medium relative to the image forming body;

a plurality of rollers rotatably mounted and supporting the transfer belt such that the belt can be run; and a charger for causing that surface of the transfer belt which is located on the image forming body side to be charged with a polarity opposite to said predetermined polarity, the improvement in which said transfer belt includes:

a first layer formed on the side at which it faces said image forming body and formed of a material having a resistivity of above $10^{10}$ Ωcm; and a second layer formed on the side opposite to that on which said image forming body is provided, and formed of a material having a resistivity lower than said resistivity of said first layer;

said charger including a contact member formed of a pliable material, having a predetermined resistivity and contacting the surface of said first layer to form a surface potential on the surface of said first layer, an electrode connected to the contact member and having a resistivity lower than that of said contact member, and means for supplying a voltage on the electrode to charge said first layer and at least one of said rollers is made of an electroconductive material, contacting the surface of said second layer and grounded.

2. The transfer device according to claim 1, in which said second layer is made of a material having a resistivity below $10^8$ Ωcm.

3. The transfer device according to claim 2, in which a bonding agent layer is provided between the first layer and the second layer to obtain a bond therebetween.

4. The transfer device according to claim 3 in which said bonding agent layer is made of an electroconductive material.

5. The transfer device according to claim 4 in which said image forming body has a predetermined surface potential to retain a toner image on its surface, and said transfer belt is disposed relative to said charger to form on the surface of the first layer a surface potential greater than a predetermined surface potential of an image forming body.

6. The transfer device according to claim 5, in which said first layer is formed of an endless resin film of a high dielectric material and said second layer is formed of an endless belt including an electroconductive rubber.

7. The transfer device according to claim 6, in which said resin film is made of a heat-shrinkable material.

8. The transfer device according to claim 1 in which the contact member comprises a fiber base and furs planted on the fiber base.

9. The transfer device according to claim 8, which further comprises a base and a cushioning layer formed on that portion of said base which faces the first layer of the transfer belt, and in which said electrode is provided on that side of said cushioning layer which faces the first layer, and the fiber base is tightly bonded to the electrode by a conductive bonding agent.

10. The transfer device according to claim 9 in which the voltage supply means comprises a direct current power source.

11. The transfer device according to claim 1, which further includes a cleaning device disposed opposite to the surface of the first layer of the transfer device to remove the toner deposited on the surface of the transfer belt.

12. The transfer device according to claim 11, in which said cleaning device has a blade for slidably contacting the surface of the first layer of the transfer belt and a box for receiving the toner which is scraped by the blade off the surface of the transfer belt.

13. The transfer device according to claim 12 in which said blade is made of an electroconductive material and said cleaning device further includes voltage supply means connected to said blade.

14. The transfer device according to claim 13, in which said voltage supply means includes an alternating current power supply.

15. The transfer device according to claim 11, in which said cleaning device comprises a contact member formed of a pliable material, having a predetermined resistivity and contacting the surface of the first layer, an electrode connected to the contact member and having a resistivity lower than that of the contact member, and means for supplying a voltage on the electrode to discharge the first layer.

16. The transfer device according to claim 15 in which the contact member of the cleaning device comprises a fiber base and furs planted on the fiber base.

17. The transfer device according to claim 16, in which the voltage supply means comprises an alternating current power source.

* * * * *